US006666456B1

(12) United States Patent
Swankie

(10) Patent No.: US 6,666,456 B1
(45) Date of Patent: Dec. 23, 2003

(54) AMUSEMENT DUNK TANK STEP ASSEMBLY

(76) Inventor: Robert C. Swankie, 7374 S. Bonarden La., Tempe, AZ (US) 85283

( * ) Notice: Subject to any disclaimer, the term of this patent is extended or adjusted under 35 U.S.C. 154(b) by 0 days.

(21) Appl. No.: 10/008,801

(22) Filed: Nov. 13, 2001

(51) Int. Cl.[7] ..... F41J 5/14; E06C 1/36
(52) U.S. Cl. ..... 273/384; 182/189
(58) Field of Search ..... 182/189; 273/384

(56) References Cited

U.S. PATENT DOCUMENTS

| | | | | | |
|---|---|---|---|---|---|
| 455,639 | A | * | 7/1891 | Roden | 182/189 |
| 508,816 | A | * | 11/1893 | Craig | 182/156 |
| 992,785 | A | * | 5/1911 | Lloyd | 182/163 |
| 1,021,019 | A | | 3/1912 | Van Kannel | |
| 1,413,770 | A | | 4/1922 | Palaith | |
| 1,964,124 | A | * | 6/1934 | Keller | 108/96 |
| 2,202,738 | A | | 5/1940 | Keller | |
| 3,586,124 | A | * | 6/1971 | Kunzweiler et al. | 182/57 |
| 3,991,851 | A | * | 11/1976 | Gannon | 182/86 |
| 4,023,647 | A | * | 5/1977 | Confer | 182/108 |
| 4,388,983 | A | * | 6/1983 | Bartels et al. | 182/189 |
| 4,466,616 | A | | 8/1984 | Griego et al. | |
| 4,535,871 | A | * | 8/1985 | Lapeyre | 182/93 |
| 4,907,674 | A | * | 3/1990 | Miller | 182/150 |
| 4,943,064 | A | | 7/1990 | Smith, Jr. | |
| 5,087,054 | A | | 2/1992 | O'Neil | |

* cited by examiner

*Primary Examiner*—Mark S. Graham
(74) *Attorney, Agent, or Firm*—Schmeiser, Olsen & Watts

(57) ABSTRACT

An amusement dunk tank step assembly configured to position and allow patrons dropped into dunk tanks to easily exit therefrom and reseat themselves upon platforms, to removably mount to dunk tanks in a plurality of locations, and/or to retrofit virtually any existing dunk tank. The dunk tank step assembly includes a mounting member configured to removably mount on an upper portion of the dunk tank. An upper portion of a rail member is coupled to the mounting member and is configured to be adjacent to an internal portion of the dunk tank when the step assembly is in an operative position. A step member is coupled to a lower portion of the rail member and is configured to be adjacent to the internal portion of the dunk tank when the step assembly is in an operative position.

20 Claims, 6 Drawing Sheets

AMUSEMENT DUNK TANK STEP ASSEMBLY

BACKGROUND OF INVENTION

1. Technical Field

This invention relates to the field of amusement systems, and more specifically, to an amusement dunk tank step assembly.

2. Background Art

An amusement system which has long been popular at fairs, amusement parks and other entertainment activities is a dunk tank system. Amusement dunk tank systems may be found in assorted types and styles. Some conventional dunk tank systems are non-portable in the sense that they may not be moved, or at least not moved very easily. Generally, these conventional, non-portable dunk tank systems are arduously and permanently assembled onsite so that they remain stationary and are not easily disassembled and transported from location to location.

Other conventional dunk tank systems are transportable in the sense that they may be moved, such as tub styled dunk tank systems for example. Generally, these conventional transportable dunk tank systems may be pre-fabricated and self-contained dunk tank systems with components/equipment permanently attached or molded to their frameworks so as to require little or no onsite assembly. Such dunk tank systems are typically permanently mounted upon a wheel-based, mobile trailer. Alternatively, conventional transportable dunk tank systems may have frameworks and components/equipment that are easily assembled onsite, easily disassembled, and easily transported from location to location. For example, square styled dunk tank systems are available that include a series of frames that fit together to form a square shaped framework into which a vinyl bag insert adapted to contain water is secured.

In operation, after conventional dunk tank systems are located in a suitable location, a patron sits upon a load-supporting platform or seat while other people throw balls or other objects at one or more targets, attempting to activate a release mechanism. When the target is struck, the platform is caused to drop the patron into water or some other fall-breaking fluid or material.

However, these conventional dunk tank systems have certain drawbacks that have long existed and have not been effectively overcome. In conventional dunk tank systems, once a patron is dropped into the tank, the patron must negotiate his own way out of the dunk tank to reseat himself upon the platform in preparation for being dunked again or exiting the tank all together. That is, there is no effective dunk tank mechanism that facilitates the patron's exiting of the dunk tank. Rather, the patron must push and/or pull himself up out of the dunk tank. Thus, conventional dunk tank systems do not provide a suitable mechanism that allows a patron dropped into a dunk tank to easily exit the dunk tank and reseat himself upon a platform.

DISCLOSURE OF INVENTION

Therefore, what is needed is an amusement dunk tank mechanism that allows a patron dropped into a tank to easily exit the tank and reseat himself upon a platform, thereby overcoming the aforementioned disadvantages of conventional amusement dunk tank systems. The invention solves these problems through an amusement dunk tank step assembly that is configured to provide certain advantages including: positioning and allowing patrons dropped into dunk tanks to easily exit therefrom and reseat themselves upon platforms; removably mounting to dunk tanks easily for set-up in a plurality of locations; and/or retrofitting virtually any existing dunk tank and/or fitting virtually any newly manufactured dunk tank.

Generally, an amusement dunk tank step assembly of present invention for allowing patrons to exit a dunk tank includes a mounting member configured to removably mount on an upper portion of a dunk tank. An upper portion of a rail member is coupled to the mounting member and is configured to be adjacent to an internal portion of the dunk tank when the step assembly is in an operative position. A step member is coupled to a lower portion of the rail member and is configured to be adjacent to the internal portion of the dunk tank when the step assembly is in an operative position. The mounting member, the rail member, and the step member may be integrally joined to one another in any combination.

In association with one step assembly embodiment of the present invention, the mounting member may include an insertion member configured to removably insert into the upper portion of the dunk tank when the step assembly is in an operative position. The insertion member may be parallel with the rail member. Additionally, the mounting member may further include an extension member having a first portion coupled to the upper portion of the rail member and a second portion coupled to the insertion member so that the insertion member may be parallel with the rail member.

In association with another step assembly embodiment of the present invention, the mounting member may include an extension member having a first portion coupled to the upper portion of the rail member and a second portion configured to be adjacent to a top portion and an external portion of the upper portion of the dunk tank when the step assembly is in an operative position so that the rail member and the extension member encapsulate the upper portion of the dunk tank.

In association with still other step assembly embodiments of the present invention, the rail member may be extendable along its length, the step member may be removably coupled to the lower portion of the rail member and configured to be adjustable along a length of the rail member, or the step member may include a plurality of step members coupled at operative locations along a length of the rail member.

In association with yet another embodiment of the present invention, the step assembly may further include a handle member coupled to the mounting member that extends outwardly therefrom. The mounting member may include an insertion member configured to removably insert into the upper portion of the dunk tank when the step assembly is in an operative position. The insertion member may be parallel with the handle member, and the handle member and the insertion member may be integrally joined to one another.

The present invention also provides other amusement dunk tank step assembly embodiments that include various combinations of the components. of the previous embodiments. For example, such an amusement dunk tank step assembly embodiment may include: an insertion member configured to removably insert into the upper portion of a dunk tank when the step assembly is in an operative position; a handle member coupled to the insertion member and extending outwardly therefrom; a second portion of an extension member coupled to a retaining sleeve member into which the insertion member and the handle member are coupled; an upper portion of a rail member coupled to a first portion of the extension member so that the rail member is parallel to the insertion and handle members and is configured to be adjacent to an internal portion of the dunk tank when the step assembly is in an operative position; and a step member coupled to a lower portion of the rail member configured to also be adjacent to the internal portion of the dunk tank. The insertion member, the handle member, the extension member, the rail member, and the step member may be integrally joined to one another in any combination.

The present invention also provides an amusement dunk tank step system that includes a first step assembly and a second step assembly for allowing patrons to enter and exit a dunk tank. The first and second step assemblies may be located opposite each other adjacent to internal and external portions of the dunk tank respectively, and each may include any of the previously described amusement dunk tank step assembly embodiments. The first and second step assemblies may each have a mounting member configured to removably mount on an upper portion of the dunk tank, or the first and second step assemblies may share the same mounting member. Alternatively, the second step assembly may include a bracket member coupled to an external portion of the dunk tank, a pivot member coupled to the bracket member, and a second step member coupled to the pivot member and configured to pivot between a substantially vertical position adjacent to the external portion of the dunk tank and a substantially horizontal position perpendicular to the external portion of the dunk tank.

The foregoing and other features and advantages of the present invention will be apparent to those of ordinary skill in the art from the following more particular description of the invention, as illustrated in the accompanying drawings.

BRIEF DESCRIPTION OF DRAWINGS

The invention will hereinafter be described in conjunction with the appended drawings, where like designations denote like elements, and.

DETAILED DESCRIPTION OF INVENTION

The invention provides an amusement dunk tank step assembly that is configured to provide certain advantages including: positioning and allowing patrons dropped into dunk tanks to easily exit therefrom and reseat themselves upon platforms; removably mounting to dunk tanks easily for set-up in a plurality of locations; and/or retrofitting virtually any existing dunk tank and/or fitting virtually any newly manufactured dunk tank. Generally, an amusement dunk tank step assembly of the present invention includes a mounting member configured to removably mount on an upper portion of a dunk tank. An upper portion of a rail member is coupled to the mounting member and is configured to be adjacent to an internal portion of the dunk tank when the step assembly is in an operative position. A step member is coupled to a lower portion of the rail member and is configured to be adjacent to the internal portion of the dunk tank when the step assembly is in an operative position.

Figure 1:
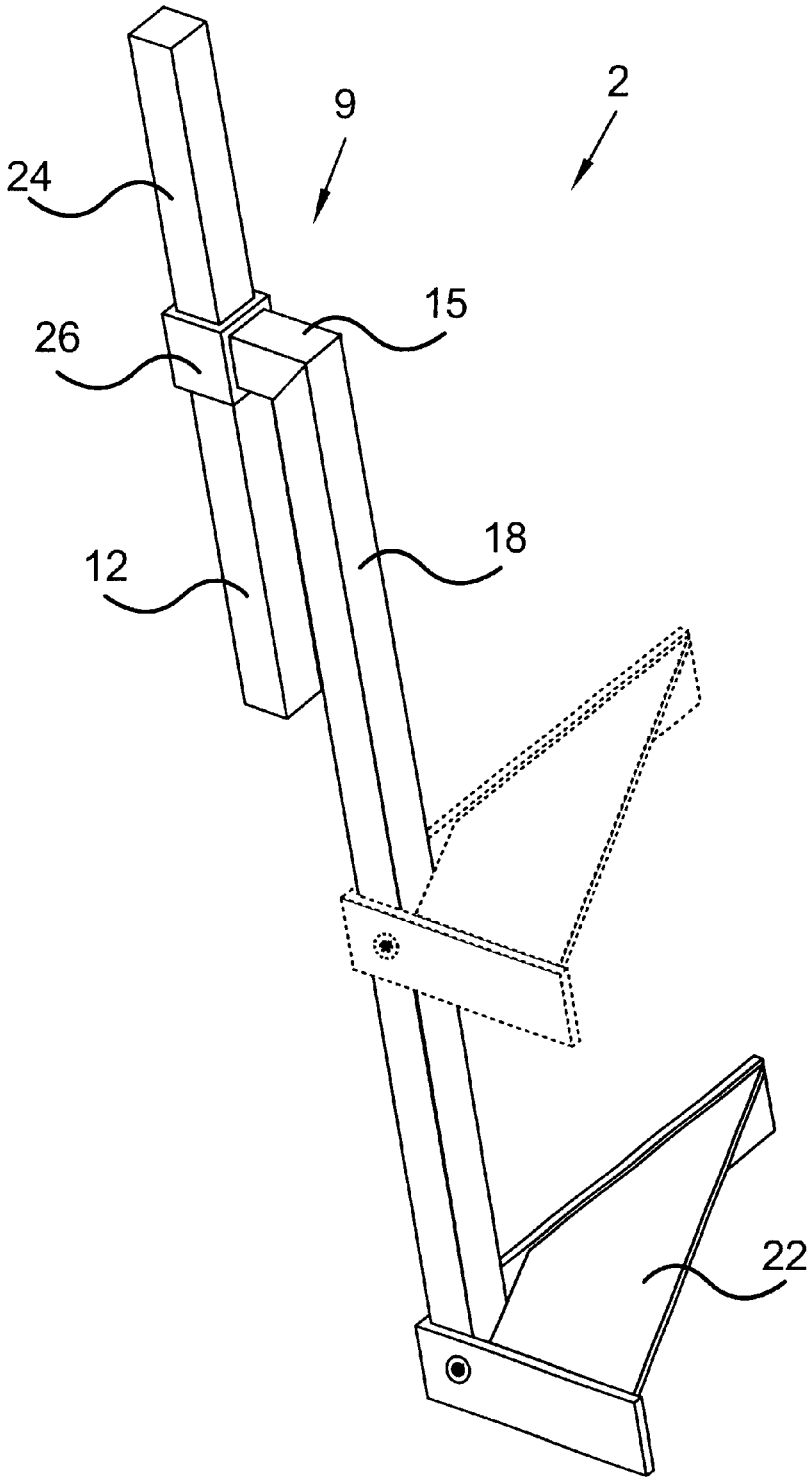
FIG. 1 is an isometric view of a dunk tank step assembly embodiment of the invention.
Figure 2:
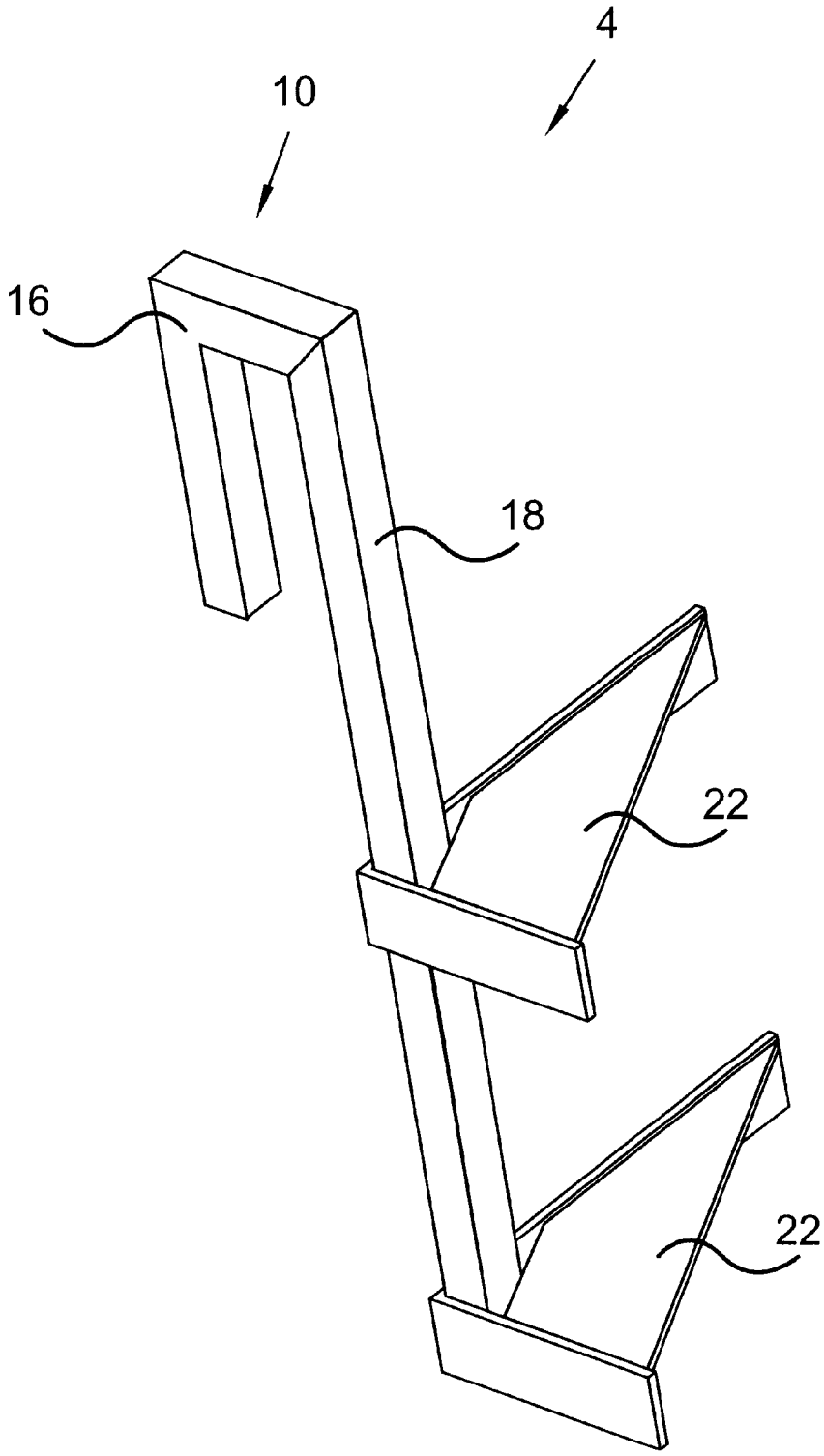
FIG. 2 is an isometric view of a dunk tank step assembly embodiment of the invention.
Figure 3:
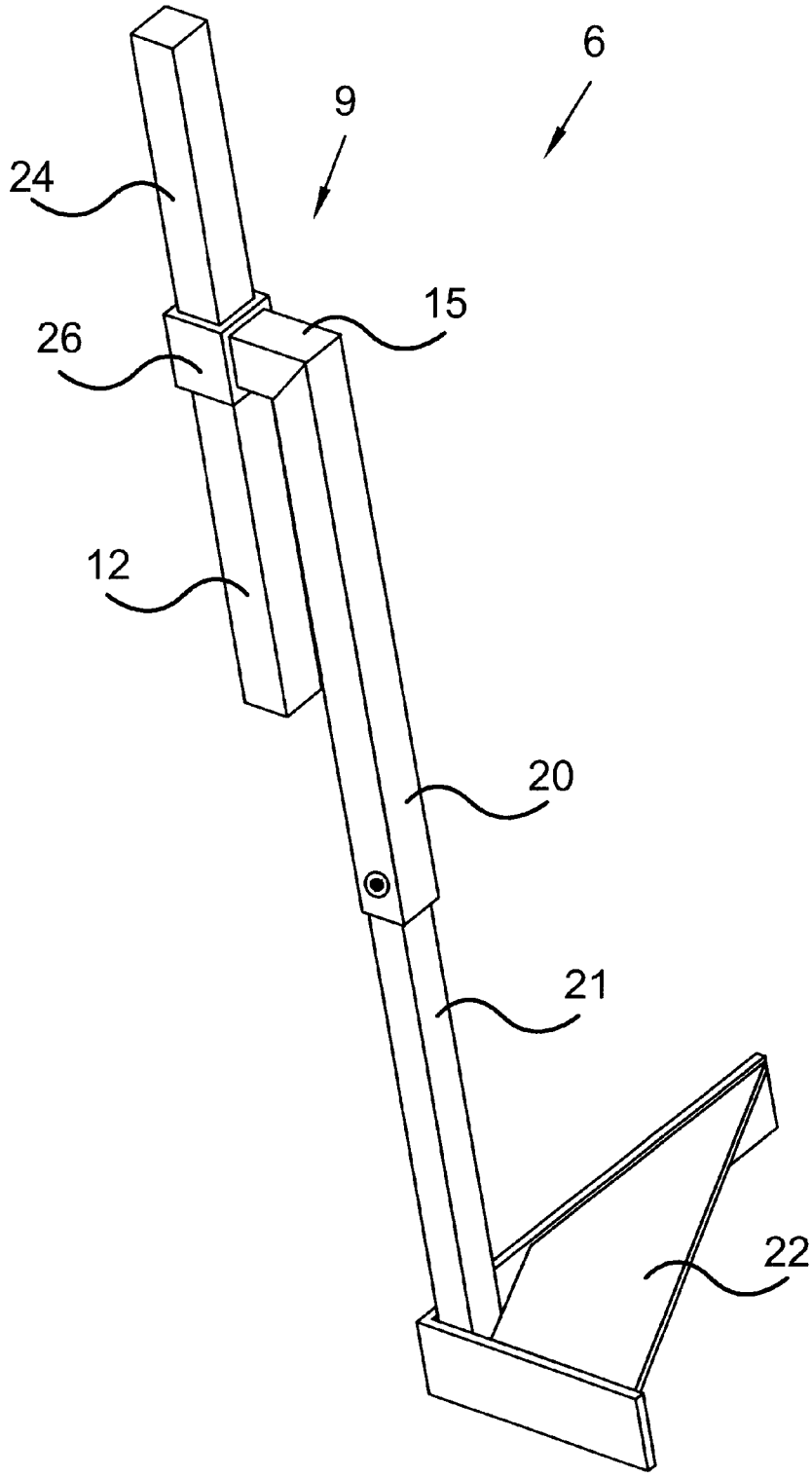
FIG. 3 is an isometric view of a dunk tank step assembly embodiment of the invention.
Figure 4:
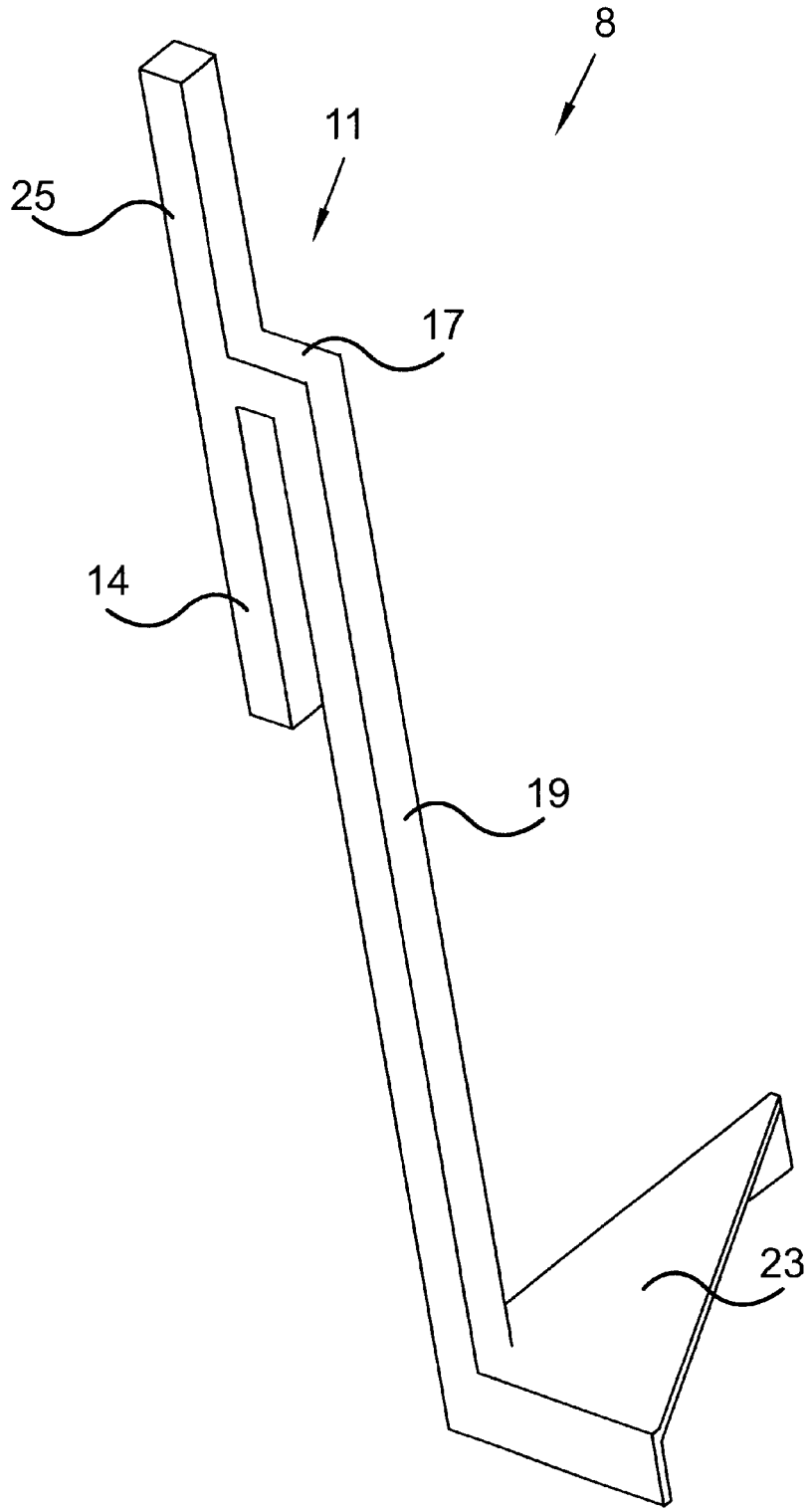
FIG. 4 is an isometric view of a dunk tank step assembly embodiment of the invention.

Particularly, the present invention may be readily adapted to a variety of embodiments of an amusement dunk tank step assembly. With reference to FIG. 1, amusement dunk tank step assembly 2 is one example of a dunk tank step assembly of the present invention. It will be understood by one of ordinary skill in the art that the invention is not limited to the specific structures illustrated in the drawings. Generally, step assembly 2 includes mounting member 9, rail member 18, step member 22, handle member 24, and retaining member 26.

Referring to FIG. 1 and describing amusement dunk tank step assembly 2 in greater detail, mounting member 9 is configured to removably mount on an upper portion of a dunk tank. Mounting members that removably mount on an upper portion of a dunk tank in any fashion are within the scope of the present invention. For the exemplary purposes of this disclosure, though, mounting member 9 includes insertion member 12 configured to removably insert into an upper portion of the dunk tank when step assembly 2 is in an operative position. Insertion members may have any structure that is adapted to removably mount into, around, over, etc. another structure.

Mounting member 9 also includes extension member 15. Extension member 15 may be substantially perpendicular to rail member 18 and insertion member 12. Thus, extension member 15 may comprise a first portion coupled to the upper portion of rail member 18 and a second portion that may be coupled to insertion member 12 or to insertion member 12 and handle member 24, depending upon their configurations, such that insertion member 12, rail member 18, and/or handle member 24 are substantially parallel with one another. However, for the exemplary purposes of this disclosure, the second portion of extension member 15 is coupled to a to retaining member 26 that is configured to couple insertion member 12 and handle member 24. Retaining member 26 may comprise a sleeve member into which is coupled handle member 24 and insertion member 12, thereby retaining them at appropriate positions relative to the particular mounting or gripping applications for example.

Insertion members, extension members, and retaining members may have various lengths and have various outside diameters depending upon the configuration of an amusement dunk tank and the particular mounting application for example. Furthermore, insertion members, extension members, and retaining members may comprise assorted shapes and structures, although insertion member 12 and extension member 15 may comprise approximately 1" outside diameter square tubing for the exemplary purposes of this disclosure, while retaining member 26 may comprise approximately 1¼" outside diameter square tubing for the exemplary purposes of this disclosure.

Rail member 18 is configured to be adjacent to an internal portion of the dunk tank when step assembly 2 is in an operative position. An upper portion of rail member 18 is coupled to a first portion of extension member 15 and rail member 18 may be perpendicular to extension member 15. Rail members may have various lengths depending upon the height of the dunk tank for example, and may also have various outside diameters depending upon the particular application. Furthermore, rail members may comprise assorted shapes and structures. As depicted in FIG. 1 and for the exemplary purposes of this disclosure, though, rail member 12 may comprise approximately 1" outside diameter square tubing.

Step member 22 is also configured to be adjacent to the internal portion of the dunk tank when step assembly 2 is in an operative position and is coupled to a lower portion of rail member 18. Step members may have various sizes, etc. depending upon the configuration of the dunk tank and the particular application for example. Furthermore, any step configuration or structure is within the scope of the present invention. Thus, step members may be assorted configurations (e.g. rectilinear, curvilinear, etc.) depending upon the configuration of the dunk tank for example, and may be comprised of a variety of structures as well. However, as depicted in FIG. 1 and for the exemplary purposes of this disclosure, step member 22 may have a right-angled triangular shape configuration and comprise an L-shaped bracket coupled to a step plate, the bracket and the plate having approximately a ¼" thickness.

Handle member 24 is configured to facilitate exiting and entering a dunk tank. Handle member 24 is coupled to the mounting member 9, and more specifically, it is coupled to insertion member 12 and extends outwardly therefrom in a substantially parallel fashion. Handle member 24 and insertion member 12 may be integrally joined to one another. Handle members may have various lengths and have various outside diameters depending upon the particular application. Furthermore, handle members may comprise assorted shapes and structures that allow gripping. As depicted in FIG. 1 and for the exemplary purposes of this disclosure, handle member 24 may comprise approximately 1" outside diameter square tubing.

Turning to FIGS. 1–4, alternate amusement dunk tank step assembly embodiments of the present invention are respectively illustrated that are similar to step assembly 2 embodiment previously described. Therefore, only differences between step assembly embodiments will be highlighted. The following step assembly embodiments and those previously described may be combined in any manner within the scope of the present invention.

A mounting member configured to removably mount on an upper portion of a dunk tank in any fashion is within the scope of the present invention. In some step assembly embodiments of the present invention, any mounting member and rail member within the scope of the present invention in combination may form a hook-shape, cane-shape, or other similar shape for removably surrounding/encapsulating the upper portion of an amusement dunk tank when the step assembly is removably mounted in a plurality of operative locations to accommodate dunk tank component/equipment configurations, etc. For example, in FIG. 2, mounting member 10 may include extension member 16 having a first portion coupled to the upper portion of rail member 18 and a second portion configured to be adjacent to a top portion and an external portion of the upper portion of a dunk tank when step assembly 4 is in an operative position so that rail member 18 and extension member 16 encapsulate the upper portion of the dunk tank.

In association with still other step assembly embodiments of the present invention, a step member may include a plurality of step members coupled and positioned at operative locations along a length of any rail member within the scope of the present invention to account for varying heights of dunk tanks and patrons, etc. For example, in FIG. 2, two step members are coupled and positioned at operative locations along a length of rail member 18, although any number of step members may be utilized.

In association with yet other step assembly embodiments of the present invention, any rail member within the scope of the present invention may be extendable along its length. That is, a particular rail member may be configured to telescope, extend, adjust, or the like in any manner or by any mechanism, while still being able to couple to a mounting member and a step member within the scope of the present invention. For example, turning to FIG. 3, step assembly 6 similar to step assembly 2 in FIG. 1 includes a rail member that comprises sleeve portion 20 that slidably removably receives appendage portion 21 allowing the overall length of step assembly 6 to be extended to accommodate varying heights of dunk tanks and patrons for example. Sleeve and appendage portions 20 and 21 may include aligning apertures adapted to removably receive a securing pin, set screw, or the like to secure appendage portion 21 within sleeve portion 20 once a desired rail member length is achieved. Alternatively, appendage portion 21 may include pop-pins or the like that are received by aligning apertures of sleeve portion 20 to achieve the same results. For the exemplary purposes of this disclosure, appendage portion 21 may comprise approximately 1" outside diameter square tubing, while sleeve portion 20 may comprise approximately 1¼" outside diameter square tubing for the exemplary purposes of this disclosure.

In association with even other step assembly embodiments of the present invention, a step member may be removably coupled to the lower portion of the rail member and configured to be adjustable (i.e., moved and removably coupled and positioned at other operative locations) along a length of any rail member within the scope of the present invention to account for varying heights of dunk tanks and patrons, etc. For example, in FIG. 1, step member 22 may be removably coupled to the lower portion of rail member 18. As depicted by the dashed outline of step member 22 approximately at a center portion of rail member 18, step member 22 may be moved/adjusted and removably coupled and positioned at the position indicated or at any other operative locations along rail member 18. Thus, step member 22 may be configured to adjust or the like in any manner or by any mechanism, such as those outline previous rail member embodiments, while still being able to couple to a rail member within the scope of the present invention.

Amusement dunk tank step assembly embodiments of the present invention may be formed of any of many different types of light weight, but sturdy/rigid materials or combinations thereof that can readily be formed into shaped objects, such as composites, polymers, fiber glass reenforced polymers, or other plastic like materials known in the art for example, metals, such as steel, galvanized steel, stainless steel, or corrosion-resistant metals like zinc or magnesium, or alloys, such as aluminum. Step assembly components may comprise any overall configuration, size, structure, and the like, including tubing, rods, beams, plates, panels, girders, brackets, frames, angles, channels, etc. For example, although some step assembly components illustrated in FIGS. 1–6 are substantially square-shaped in cross-section, these and other components might be any rectilinear or curvilinear shape in cross-section.

The components defining any amusement dunk tank step assembly embodiment of the present invention may be manufactured separately and then assembled together. However, the components may be manufactured simultaneously and integrally joined with one another. Manufacture of these components separately or simultaneously may involve either injection molding, casting, milling, or the like. If any of the components are manufactured or bought separately, they may then be coupled with one another by any mechanism and in any manner known in the art, such as with adhesive, welds, fasteners, clamps, or the like for example, depending on, among other considerations, the particular material forming the components. Other possible steps are sand blasting or polishing the components and powder coating or painting to a desired color.

Accordingly, amusement dunk tank step assembly components of any embodiment of the invention, including an insertion member, an extension member, a retaining member, a rail member, a step member, a handle member, or any combination thereof, may be integrally joined to (i.e., unitary with) one another. For example, as depicted in step assembly embodiment 8 of FIG. 4, mounting member 11, including insertion member 14 and extension member 17, handle member 25, rail member 19, and step 23 are all integrally joined to one another. Nevertheless, in other step assembly embodiments within the scope of the present invention, only certain combinations of step assembly components may be integrally joined to one another, such as a handle member and an insertion member, while other component combinations are coupled together. Alternatively, step assembly components may not be unitary.

The present invention also provides an amusement dunk tank step system that includes a first step assembly and a second step assembly for allowing patrons to easily enter and exit a dunk tank. Although the present invention may be readily adapted to a variety of embodiments of an amusement dunk tank step system, with reference to FIG. 6, amusement dunk tank step system 48 is an example of a dunk tank step system of the present invention.

Amusement dunk tank step assembly embodiments of the present invention have previously been described, and the first step assembly of step system 48 is similar to or may be any one of the step assembly embodiments previously described. Accordingly, the first step amusement dunk tank assembly may be step assembly 2 for the exemplary purposes of this disclosure. Step assembly 2 may be removably mounted onto an upper back corner portion of dunk tank 32. However, step assembly 2 may be removably mounted in a plurality of locations along an upper portion of dunk tank 32 depending on the location of components/equipment of amusement dunk tank system 30, including platform 34 and step assembly 50, for example.

Figure 5:
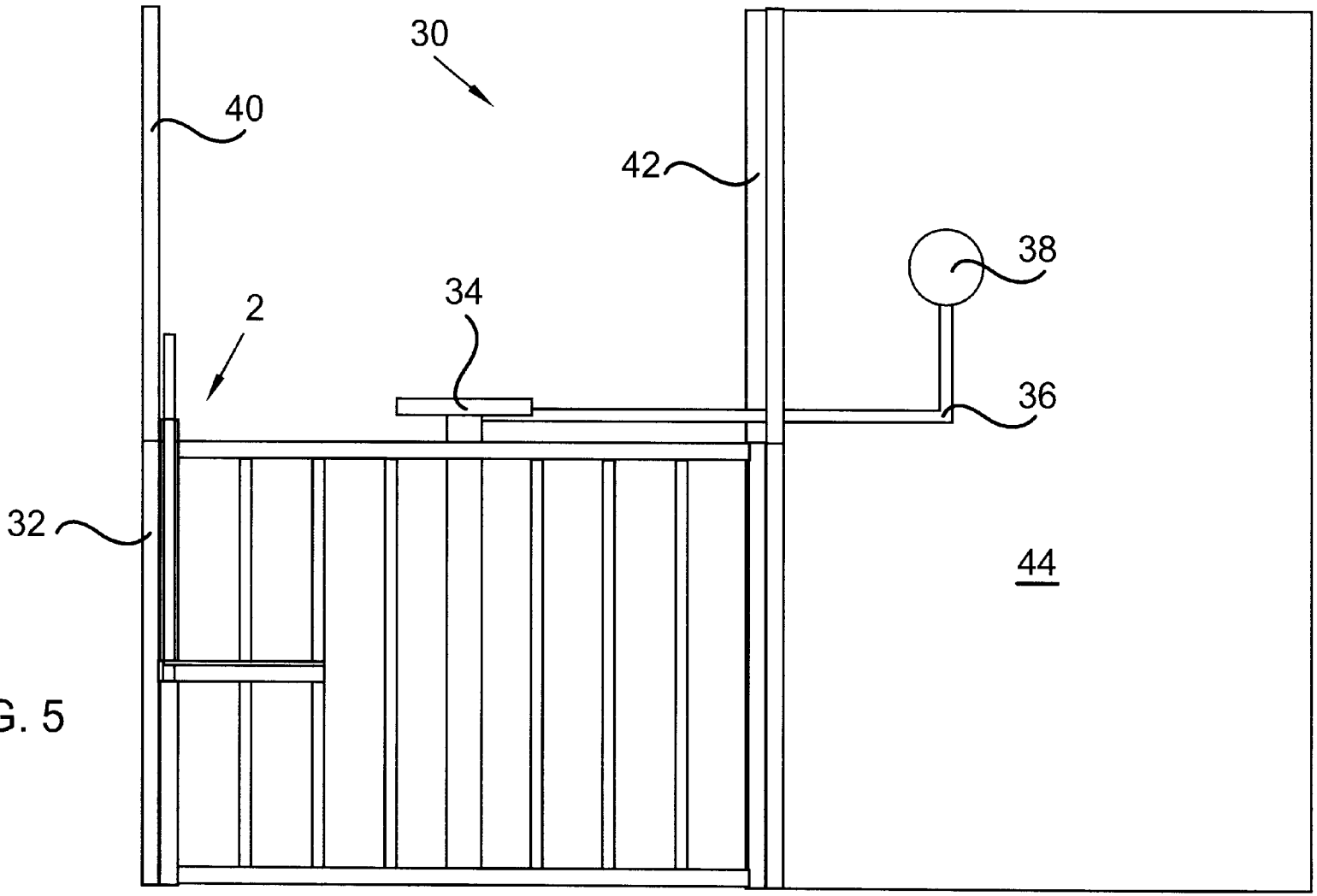
FIG. 5 is a cross-sectional front plan view of a dunk tank system with the step assembly embodiment of FIG. 1 removably mounted on a dunk tank in an operative position.
Figure 6:
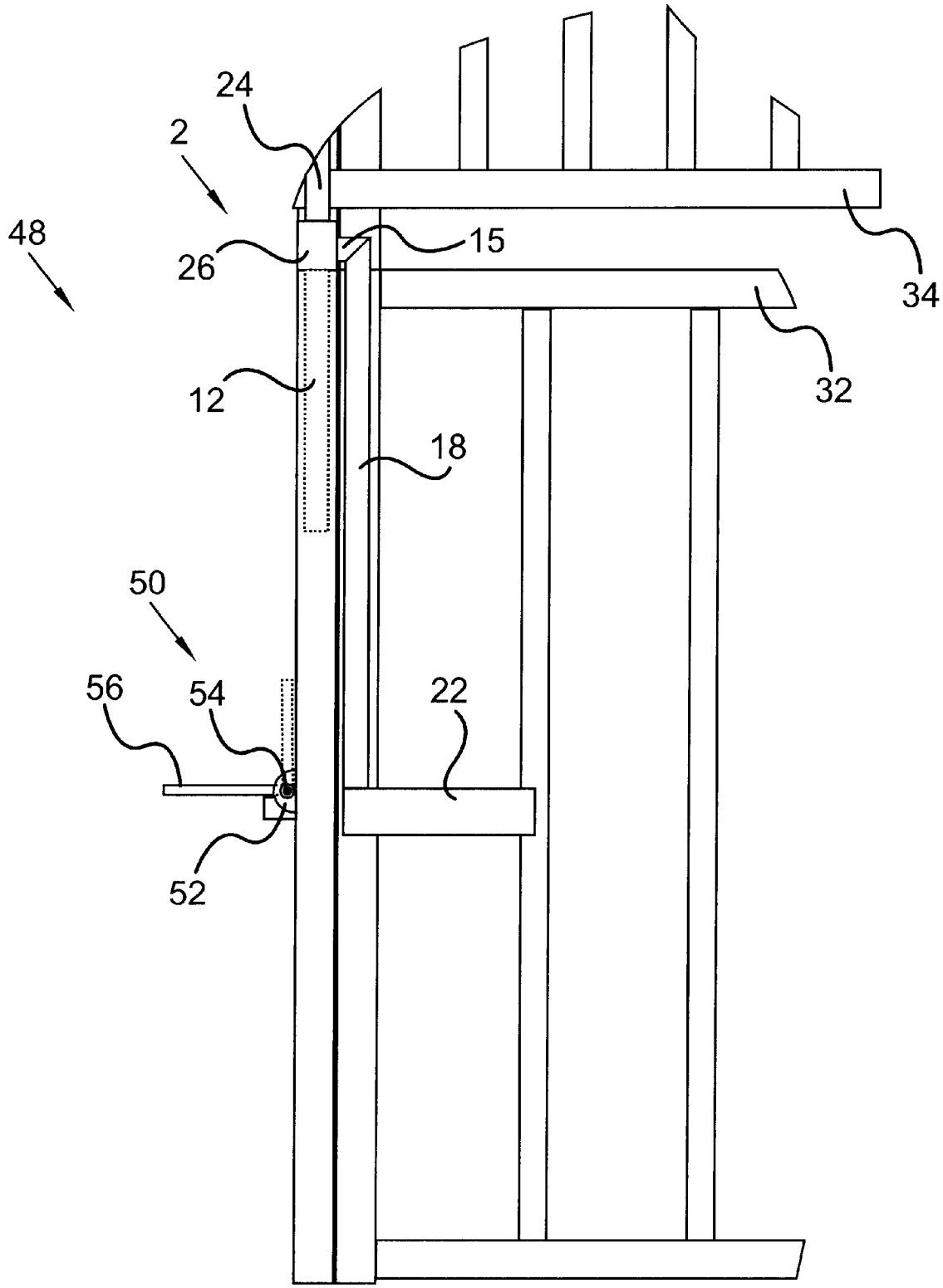
FIG. 6 is a partially broken away cross-sectional side plan view of the dunk tank system of FIG. 5 in conjunction with a step system embodiment of the invention.

With reference to FIGS. 5–6, step assembly 2 includes insertion member 12 configured to removably insert into an upper portion of dunk tank 32 in any manner when step assembly 2 is in an operative position. For example, insertion member is inserted into a vertically oriented, tubular, square-shaped framework element of dunk tank 32 in FIG. 6. Handle member 24 is coupled to insertion member 12 and extends outwardly therefrom. A second portion of extension member 15 is coupled to retaining member 26 including a sleeve member into which are coupled handle member 24 and insertion member 12. An upper portion of rail member 18 is coupled to a first portion of extension member 15. Rail member 18 configured to be adjacent to an internal portion of dunk tank 32 when step assembly 2 is in an operative position. In dunk tank 32 of FIGS. 5–6, though not shown for clarity purposes, a tank insert comprises the internal portion of dunk tank 32. Step member 22 is coupled to a lower portion of rail member 18. Step member 22 is also configured to be adjacent to the internal portion (e.g. tank insert) of dunk tank 32 when step assembly 2 is in an operative position.

The second amusement dunk tank step assembly may be similar to or may be any one of the step assembly embodiments previously described as well. Accordingly, in association with one second amusement dunk tank step assembly embodiment of the present invention, the second step assembly includes a second mounting member configured to removably mount on an upper portion of dunk tank 32 for example. An upper portion of a second rail member is coupled to the second mounting member, the second rail member configured to be adjacent to an external portion of dunk tank 32 when the second step assembly is in an operative position. A second step member is. coupled to a lower portion of the second rail member, the second step member configured to be adjacent to the internal portion of dunk tank 32 when the second step assembly is in an operative position. Alternatively, the second step assembly may not include a second mounting member, and instead an upper portion of the second rail member may be coupled to mounting member 9 of first step assembly 2.

As depicted in FIG. 6, in association with another second amusement dunk tank step assembly embodiment of the present invention and for the exemplary purposes of this disclosure, the second step assembly may be amusement dunk tank step assembly 50, which includes bracket member 52, pivot member 54, and a step member 56. Bracket member 52 may be either securely or removably coupled to an external portion of dunk tank 32 in any manner, and is typically opposite step 22 of step assembly 2 to facilitate entering and exiting dunk tank 32. Bracket member 52 comprises opposing semicircular-shaped retaining portions, though any other configuration and the like is within the scope of the invention. Bracket member 52 may also comprise a stop portion that keeps step 56 in an operative position, such as the opposing square-shaped stop portion depicted in FIG. 6, though any other configuration and the like is within the scope of the invention.

Pivot member 54 is coupled to and retained by bracket member 52. That is, ends of pivot member 54 are located in apertures of the opposing semicircular-shaped retaining portions so that pivot member 54 retained between the opposing semicircular-shaped retaining portions of bracket member 52. Pivot member may be a circular rod or tubular portion for example, though any other configuration and the like is within the scope of the invention.

Step member 56 is coupled to pivot member 54 in any manner. For example, an end of step member 56 may be wrapped around pivot member 54, or the end may be otherwise coupled thereto in any manner. Step 56 is configured to pivot between a substantially vertical position adjacent to the external portion of dunk tank 32 and a substantially operative, horizontal position perpendicular to the external portion of dunk tank 32. Thus step 56 may pivot between approximately 0° to 100°. Step 56 may be any rectilinear or curvilinear configuration and may comprise a plate that is approximately ¼" thick.

Describing the use of amusement dunk tank step assembly and system embodiments of the present invention further and for the exemplary purposes of this disclosure, reference is made to amusement dunk tank system 30 in FIGS. 5–6. Amusement dunk tank system 30 is a portable dunk tank system having a substantially square overall configuration, though any rectilinear or curvilinear shaped dunk tank and the like is within the scope of the invention. Amusement dunk tank system 30 has components/equipment and pre-fabricated framework panels each comprised of tubular square-shaped elements welded together, all of which are easily assembled onsite, easily disassembled, and easily transported from location to location. Notwithstanding, the invention may be utilized in virtually any amusement dunk tank system, including those previously described and of any size, configuration, or the like.

Particularly, amusement dunk tank system 30 includes dunk tank 32. Although not illustrated, dunk tank system 30 has a soft vinyl dunk tank insert or other like material dunk tank insert that is secured to the upper portion of dunk tank 32 framework (such as by velcro straps) and contains fall-breaking fluid or material such as water. Platform 34 is collapsibly mounted on dunk tank 32 framework. Release mechanism member 36 is L-shaped having a first end coupled to platform 34. Target 38 is coupled to a second end of release mechanism member 36. Protection framework 40 may comprise similar materials as that of dunk tank 32 and/or may comprise a net for example. Protection framework 40 is mounted to the front (not shown) and sides of dunk tank 32 so that objects that are thrown at target 38 do not hit the patron sitting above dunk tank 32 on platform 34. L-shaped side frame 42 extends laterally from tank 32 and coupled thereto is curtain 44 forming a backstop for target 38. Curtain 44 may be plastic, canvas, cloth, netting, fencing, or any other material for example, and is mounted by any acceptable mechanism, such as hooks, or may be folded over itself and sewn so as to form a sleeve portion on the top thereof that slidably receives a portion of L-shaped side frame 42. Step system 48 is also included and comprises step assemblies for allowing patrons to enter and exit a dunk tank. For the exemplary purposes of this disclosure, dunk tank step system 48 includes step assembly 50 and step assembly 2, although any other step assembly embodiment may be included.

In operation, a patron enters dunk tank 32 utilizing step assembly 50 and handle 24. With a foot, the patron may fold down step member 56, place a foot thereon, grab handle 24, and step and pull himself up in order to sit upon platform 34. When target 38 is struck by people throwing objects, release mechanism member 36 is activated causing platform 34 to collapse. The patron is then dropped into fall-breaking fluid or material contained in the dunk tank insert. Unlike conventional dunk tank systems where the patron must negotiate his own way out of the dunk tank (e.g. by pushing and/or pulling himself up out of dunk tank 32 by trying to grab dunk tank framework or protection framework 40) to reseat himself upon the platform, step assembly 2 allows the patron in dunk tank 32 to easily exit dunk tank 32.

Particularly, the patron places a foot on step 22, grabs handle 24, and steps and pulls himself up. Because of the configuration of step assembly 2 for example, step 22 is located at a height that positions the patron's body at a level that allows him to easily reseat himself upon the platform. The patron may then swing himself to face forward in preparation for being dunked again, or may swing himself to face rearward in preparation from exiting dunk tank system 30 all together using step assembly 50 and handle 24. Additionally, dunk tanks and patrons come in a variety of sizes and shapes for example. Accordingly, step assembly 2 and other step assembly embodiments of the present invention that have extendable rail members, an adjustable step, or a plurality of steps for example will virtually always have a step or steps located at such a height that, when used, will position a patron's body at a level that allows him to easily reseat himself upon the platform.

Accordingly, amusement dunk tank step assemblies of the present invention overcome the aforementioned drawbacks of previous conventional amusement dunk tank systems. The invention provides an amusement dunk tank step assembly that includes a mounting member configured to removably mount on an upper portion of a dunk tank. An upper portion of a rail member is coupled to the mounting member and is configured to be adjacent to an internal portion of the dunk tank when the step assembly is in an operative position. A step member is coupled to a lower portion of the rail member and is configured to be adjacent to the internal portion of the dunk tank when the step assembly is in an operative position. Amusement dunk tank step assemblies of the present invention are thus configured to provide certain advantages including: positioning and allowing patrons dropped into dunk tanks to easily exit therefrom and reseat themselves upon platforms; removably mounting to dunk tanks easily in a plurality of locations; and/or retrofitting virtually any existing dunk tank and/or fitting virtually any newly manufactured dunk tank. Moreover, the step assembly and system of the present invention are easy to manufacture, assemble, and maintain.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, unless otherwise specified, any components of the present invention indicated in the drawings or herein are given as an example of possible components and not as a limitation. Similarly, unless otherwise specified, any steps or sequence of steps of the method of the present invention indicated herein are given as examples of possible steps or sequence of steps and not as limitations.

What is claimed is:

1. An amusement dunk tank step assembly system comprising:

a curvilinear dunk tank;

only one mounting member removably mounted on an upper portion of the curvilinear dunk tank;

only one rail member, the only one rail member adjacent to an internal portion of the curvilinear dunk tank, wherein the only one rail member comprises an upper portion coupled to the only one mounting member; and at least one step member adjacent to the internal portion of the curvilinear dunk tank, wherein the at least one step member comprises at least one step member coupled to a lower portion of the only one rail member, the at least one step member shaped to conform to a curved wall of the curvilinear dunk tank along an edge of the at least one step member adjacent to the curved wall of the curvilinear dunk tank.

2. The step assembly of claim 1, wherein the only one mounting member comprises an insertion member removably inserted into the upper portion of the curvilinear dunk tank.

3. The step assembly of claim 2, wherein the only one mounting member further comprises an extension member, the extension member having a first portion coupled to the upper portion of the only one rail member and having a second portion coupled to the insertion member.

4. The step assembly of claim 1, wherein the only one mounting member comprises an extension member, the extension member having a first portion coupled to the upper portion of the only one rail member and a second portion adjacent to a top portion and an external portion of the upper portion of the curvilinear dunk tank so that the only one rail member and the extension member embrace the upper portion of the curvilinear dunk tank.

5. The step assembly of claim 1, wherein the only one rail member comprises a rail member extendable along its length.

6. The step assembly of claim 1, wherein the at least one step member is removably coupled to the lower portion of the only one rail member, wherein the at least one step comprises at least one step configured to be adjustable as to position along a length of the only one rail member.

7. The step assembly of claim 1, wherein the at least one step member comprises a plurality of step members coupled at operative locations along a length of the only one rail member.

8. The step assembly of claim 1, wherein the only one mounting member, the only one rail member, and the at least one step member are integrally joined to one another.

9. The step assembly of claim 1 further comprising a handle member coupled to the only one mounting member and extending therefrom.

10. The step assembly of claim 9, wherein the only one mounting member comprises an insertion member, the insertion member removably inserted into the upper portion of the curvilinear dunk tank.

11. The step assembly of claim 10, wherein the handle member and the insertion member are integrally joined to one another.

12. An amusement dunk tank step assembly for allowing patrons to exit a rectilinear dunk tank, the rectilinear dunk tank comprising a plurality of corners formed by adjacent vertical dunk tank walls, the amusement dunk tank step assembly comprising:

an insertion member configured to removably insert into an upper portion of the dunk tank when the step assembly is in an operative position;

a handle member integrally joined to the insertion member and extending therefrom;

an extension member having a first portion and a second portion;

a retaining member coupled to the second portion of the extension member, the retaining member comprising a sleeve member into which is coupled the handle member and the insertion member;

a rail member configured to be adjacent to an internal portion of the dunk tank when the step assembly is in an operative position, wherein an upper portion of the rail member is coupled to the first portion of the extension member; and at least one step member, the at least one step member configured to be adjacent to two vertical dunk tank walls at one corner of the plurality of corners in the internal portion of the dunk tank when the step assembly is in an operative position, wherein the at least one step member is coupled to a lower portion of the rail member.

13. The step assembly of claim 12, wherein the rail member is extendable along its length.

14. The step assembly of claim 12, wherein the at least one step member comprises at least one step member removably coupled to the lower portion of the rail member and configured to be adjustable as to position along a length of the rail member.

15. The step assembly of claim 12, wherein the at least one step member comprises a plurality of step members coupled at operative locations along a length of the rail member.

16. The step assembly of claim 12, wherein the insertion member, the handle member, the extension member, the rail member, and the at least one step member are integrally joined to one another.

17. An amusement dunk tank step system comprising:

a dunk tank;

a first step assembly for allowing patrons to exit the dunk tank, the first step assembly comprising:

only one first mounting member removably mounted on an upper portion of the dunk tank;

only one first rail member adjacent to an internal portion of the dunk tank when the first step assembly is in an operative position, wherein an upper portion of the first rail member is coupled to the first mounting member; and at least one first step member adjacent to the internal portion of the dunk tank when the first step assembly is in an operative position, wherein the at least one first step member is coupled to a lower portion of the first rail member; and a second separate step assembly for allowing patrons to enter and exit the dunk tank, the second separate step assembly comprising:

a bracket member coupled to an external portion of the dunk tank;

a pivot member coupled to the bracket member; and a second step member coupled to the pivot member and configured to pivot between a substantially vertical position adjacent to the external portion of the dunk tank and a substantially horizontal position perpendicular to the external portion of the dunk tank.

18. An amusement dunk tank step assembly system comprising:

a rectilinear dunk tank;

only one mounting member removably mounted on an upper portion of the rectilinear dunk tank;

only one rail member, the only one rail member adjacent to an internal portion of the rectilinear dunk tank, wherein the only one rail member comprises an upper portion coupled to the only one mounting member; and at least one step member adjacent to the internal portion of the rectilinear dunk tank, the at least one step member adjacent to two adjacent sides of the rectilinear dunk tank proximate a corner of the rectilinear dunk tank, wherein the at least one step member comprises at least one step member coupled to a lower portion of the only one rail member.

19. The step assembly of claim 18, wherein the upper portion of the rectilinear dunk tank comprises an upper portion of a vertically-oriented tubular framework element.

20. The step assembly of claim 19, wherein the vertically-oriented tubular framework element of the rectilinear dunk tank comprises a portion of a corner of the rectilinear dunk tank.

* * * * *